US007185871B2

(12) United States Patent
Orozco

(10) Patent No.: US 7,185,871 B2
(45) Date of Patent: Mar. 6, 2007

(54) TIE-DOWN FOR BULKY EQUIPMENT EXPOSED TO WINDSTORMS

(75) Inventor: Michael M. Orozco, Glendora, CA (US)

(73) Assignee: Carson Industries LLC, Glendora, CA (US)

( * ) Notice: Subject to any disclaimer, the term of this patent is extended or adjusted under 35 U.S.C. 154(b) by 0 days.

(21) Appl. No.: 10/424,596

(22) Filed: Apr. 28, 2003

(65) Prior Publication Data

US 2004/0211878 A1 Oct. 28, 2004

(51) Int. Cl.
*B65D 63/00* (2006.01)

(52) U.S. Cl. ..... 248/499; 248/500; 248/505; 248/679

(58) Field of Classification Search ..... 248/499, 248/500, 505, 507, 678, 679, 680, 681, 346.01
See application file for complete search history.

(56) References Cited

U.S. PATENT DOCUMENTS 3,722,845 A * 3/1973 Unger ..... 248/346.03
4,044,513 A 8/1977 Dieke
4,714,225 A * 12/1987 Skinner et al. ..... 248/523
5,174,543 A * 12/1992 Corson et al. ..... 248/680
5,335,892 A * 8/1994 Busch ..... 248/551
5,687,512 A * 11/1997 Spoozak et al. ..... 52/23
5,699,993 A * 12/1997 Hill et al. ..... 248/680
5,701,175 A * 12/1997 Kostizak et al. ..... 356/326
5,873,679 A * 2/1999 Cusimano ..... 405/231
5,950,980 A * 9/1999 Folmar ..... 248/678
5,961,093 A * 10/1999 Jones et al. ..... 248/678
6,220,562 B1 * 4/2001 Konkle ..... 248/500
6,463,771 B1 * 10/2002 Judge ..... 70/68
6,634,615 B1 * 10/2003 Bick et al. ..... 248/499
6,655,648 B2 * 12/2003 Harris ..... 248/678
2002/0100854 A1 * 8/2002 Stansbury ..... 248/632

* cited by examiner

*Primary Examiner*—Amy J. Sterling
(74) *Attorney, Agent, or Firm*—Donald D. Mon

(57) ABSTRACT

A tie down resistive to strong winds for lightweight but bulky equipment. The tie down includes anchors driven into the ground which hold cables that in turn are attached to the base of the equipment.

10 Claims, 2 Drawing Sheets

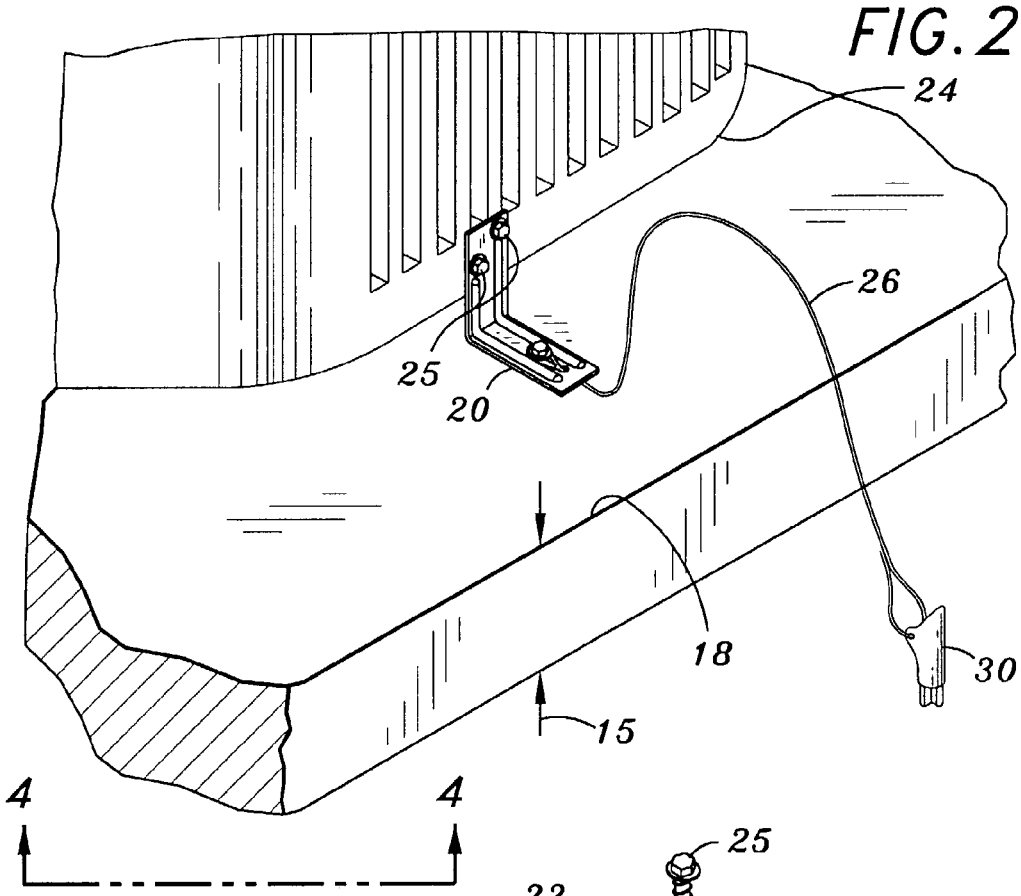
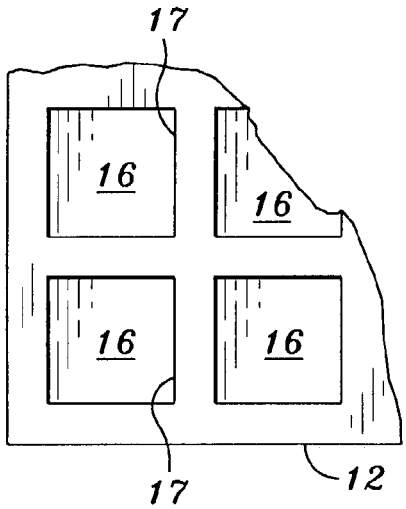
FIG. 4
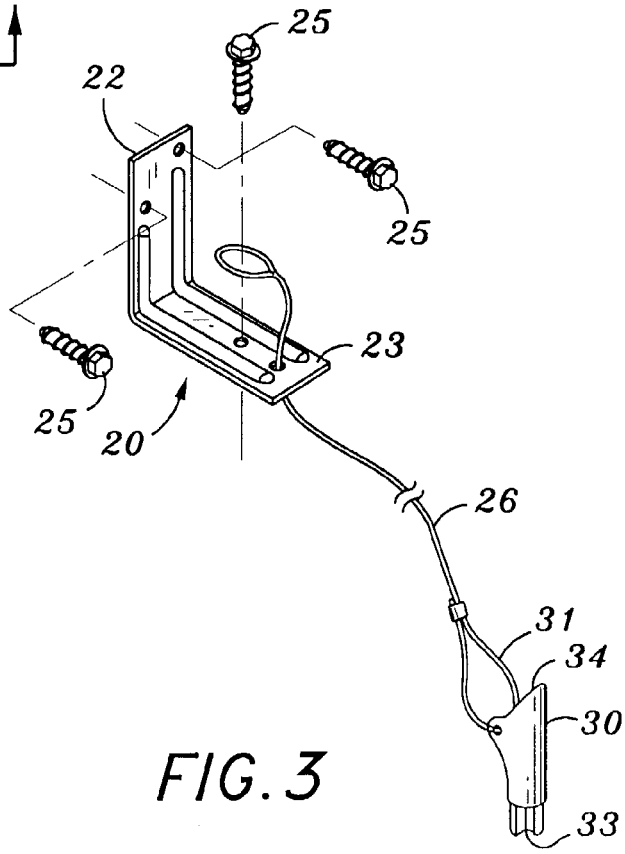
FIG. 3

TIE-DOWN FOR BULKY EQUIPMENT EXPOSED TO WINDSTORMS

FIELD OF THE INVENTION

Bulky equipment exposed to strong windstorms such as hurricanes are readily overturned or blown away at great cost. An inexpensive and sufficient tie-down is provided to hold them in place.

BACKGROUND OF THE INVENTION

Air conditioning units are commonly placed outside of the structures which they cool in order to provide for heat transfer at the condenser. This equipment is relatively light for its bulk, and is commonly contained in bulky housings that are vented to permit the flow of coolant air, namely atmospheric winds.

The winds are both a source of coolant, and a risk when the winds are heavy, such as in hurricane conditions. Then there is a well-recognized risk of being blown away. This is a major source of loss from strong windstorms.

Of course this problem has been recognized, but it is offset by the cumbersome inconvenience of heavy bases, such as concrete bases, which because of their weight can restrain a suitably mounted structure from being blown away. Such heavy bases are difficult to install, and are quite expensive. Generally preference is given to light weight plastic bases which can be readily be carried around and laid in place. These function well in benign times of moderate winds. However they do not have sufficient weight for their combination with a piece of equipment to resist very high winds.

Another problem relates to where the unit is to be placed. This invention is not directed to installations on roofs or other structures, where heavy bases or complicated tie-down systems are required. Instead it relates to outdoor ground-level installations where a light weight base can be used.

BRIEF DESCRIPTIONS OF THE INVENTION

This invention is directed to the out of doors tying-down of a housing and its enclosed equipment. The object is to secure them from being upset, overturned, or blown away by high winds such as hurricanes. This invention is not dependent on the mass of a heavy base, such as a concrete base.

Instead, according to this invention, a light weight base such as a honeycombed organic plastic material, which may even be a foam, is used. It is a rigid structure able to support what is placed on it, for example an air conditioner compressor.

According to this invention, a plurality of rigid clips is attached to the housing or to the base, and preferably to both. A cable connection to each clip at the base extends over and in contact with the edge of the base, to an anchor driven into the ground that tightly pulls on the cable. That is all, and it results in an installation resistant to very high winds.

The above and other features of this invention will be fully understood from the following detailed description and the accompanying drawings, in which:

BRIEF DESCRIPTION OF THE DRAWINGS

FIG. 2 is a perspective view showing the invention partly installed;

FIG. 3 is an exploded view of an unassembled tie-down; and

FIG. 4 is a fragmentary view of the bottom of the base.

DETAILED DESCRIPTION OF THE INVENTION

Figure 1:
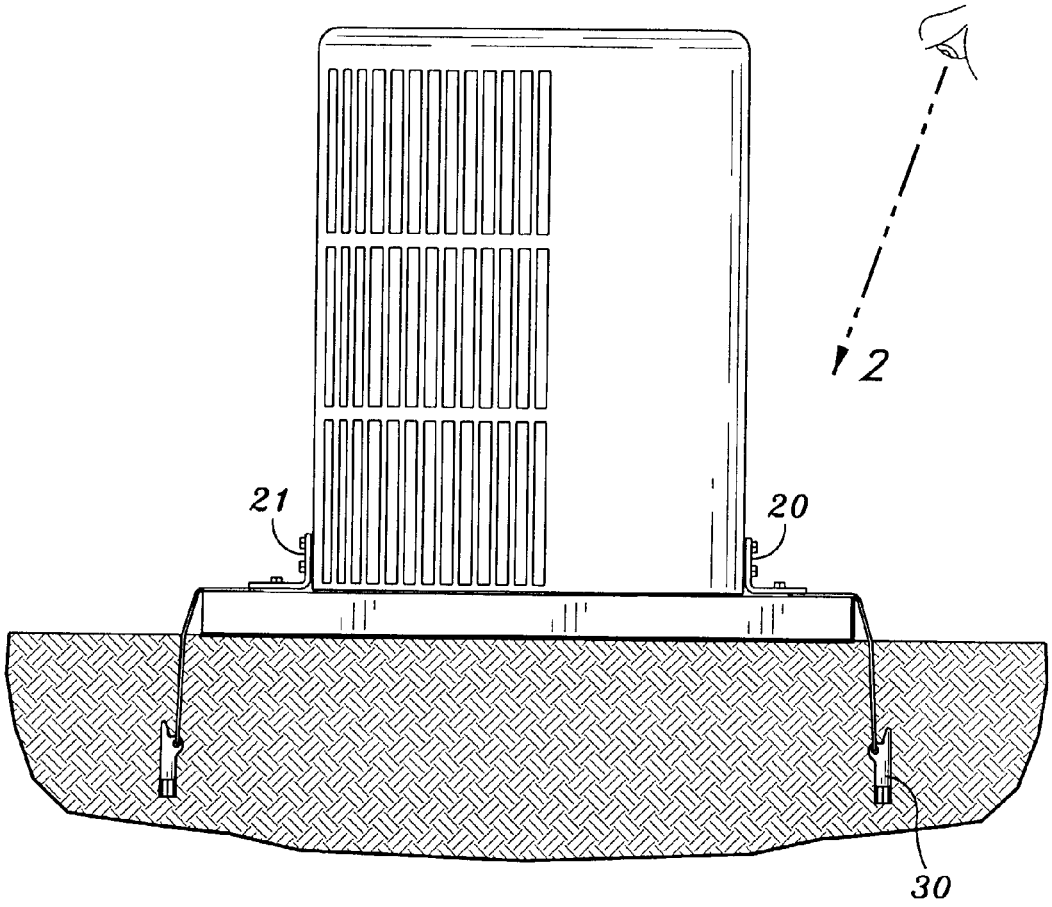
FIG. 1 is a side view partly in cutaway cross-section, showing the invention tying down a compressor housing.

A housing 10 is shown of the type which customarily houses equipment that is to be installed outdoors. The internal mechanism, which is of no particular interest to this invention and is therefore not shown, requires the flow of air through louvers 11 in the housing and over the enclosed equipment. A frequently encountered example is condensers for air conditioners. Customarily air is brought through the housing by a fan, but sometimes only by the routine flow of air current.

In any event, it must be sufficiently closed as to exclude persons and animals, or parts of them, as well as trash and debris. In gentle breezes, the weight of the equipment alone will hold the total assembly in place. However, in hurricane velocities, it can be overcome.

While many jurisdictions accept the risks inherent in lightweight bases as they are presently employed, there are others that require a heavier-weight concrete base, thereby denying the benefits of light plastic bases. It is submitted that, instead of requiring heavy bases (and often insufficient tying of the device to the heavier base), a suitably anchored light weight base with equipment suitably connected to the ground will function as well as, or better.

The tie-down contemplated by this invention includes only a light weight base 12, often rigid polyurethane (solid or foam) which usually will be rectangular, with a top surface 13 and a bottom surface 14.

The condenser or other equipment (not shown) is placed on the base, and housing 10 is placed over it.

The base will have a dimension 15 of thickness. Its bottom surface 14 (FIG. 4) is honeycombed by pockets 16 which have ribs 17 between them. The pockets rise only part way up into the base. Thus the weight is lighter, but the vertical strength remains adequate for the purposes. The base has a peripheral upper edge 18. A typical base will be about 2–3 inches tall, with internal ribs about ¼ inch thick.

A pair of clips 20, 21 is fixed to the housing and to the base. Because they are alike, only clip 20 and its related apparatus are described in detail.

Clip 20 is bent to form a first flange 22 and a second flange 23 formed by bending the clip to shape. Flange 22 is secured to the housing near the bottom edge 24 of the housing by fasteners 25 which may be as simple as thread-tapping screws, or even adhesives.

Second flange 23 is secured to the upper surface of the base, again by fasteners 26, which may be as simple as nails or expansion bolts of sufficient length to provide a good grip in the plastic base, or adhesives.

A cable 27 is retained to the second flange. The cable may be a high strength wire cable covered by plastic, or any other suitable flexible non-extensible rope or cable.

An anchor 30 is attached to the free end 31 of the cable. The anchor is of a type that can be driven into the ground by a tool, and will resist being pulled out after insertion into the ground. Toggles and barbed spears are recognized forms of such anchors. As shown, the anchor has a lead end 33, and a recess 34 to receive a tool that will drive the anchor into the ground 35. It bears against the upper edge of the base. After being driven lead end first into the ground, a pull on the cable will be resisted by the anchor and thereby will hold the base to the ground. The clip holds the housing to the base. The tension on the cable will largely be determined by how hard the anchor is driven into the ground and whether the ground around and above the anchor is filled or hardened.

Two clips will ordinarily be sufficient. If greater assurance is desired, then more clips, cables and anchors may be used, perhaps on the other sides of the housing.

Connecting both flanges of the clip to adjacent structure is preferred. However, fasteners 26 to second flange 23 can be omitted. Also, the term "fastener" is intended to include any means to hold a flange to adjacent structure, for example cements and adhesives. An advantage of this invention is the lack of need for surface preparation before installing the fastener.

This simple construction enables a device to be held down by a tension limited only by the force exerted on the anchors to drive them into the ground. The resulting arrangement is at once elegantly simple and surprisingly reliable.

This invention is not to be limited by the embodiment shown in the drawings and described in the description, which is given by way of example and not of limitation, but only in accordance with the scope of the appended claims.

What is claimed is:

1. In combination:

a housing to be secured against strong winds, said housing having a perimeter around its bottom end;

a rigid base intended to rest atop the ground having a top surface with a peripheral edge and a bottom surface below said peripheral edge and top surface, and a peripheral side wall joining said top and bottom surfaces at said peripheral edge, the said periphery perimeter of said housing being smaller than said peripheral edge so as to form a ledge on said top surface extending around said housing, said housing resting on said top surface and said bottom surface resting on the ground;

at least two unitary clips, each having a pair of flanges making a right angle with each other, and each flange having holes therethrough to pass a fastener, one flange of each clip bearing against said top surface, and the other of said flanges bearing against said housing, said clips being placed at opposite sides of said housing;

fasteners extending through at least some of said holes respectively fastening said flanges to said top surface and to said housing;

at least two flexible cables, one for each said clip, each said cable having a free end and an attachment end, said attachment end being attached to the respective one of said flanges which is fastened to said top surface; and an anchor attached to the free end of each said cables, said anchor having a sharp end adapted to be driven into the ground alongside said sidewall, pulling with its cable, said anchor being inherently adapted to react with the ground in order to resist being pulled out of the ground by a pull on the cable, said cables laying atop said ledge and against said top surface and bent directly over and against said peripheral edge, said cables below said peripheral edge being driven into the ground substantially vertically into the ground in close adjacency to said sidewall to minimize its spacing from said sidewall and to provide a substantially direct downward pull on said peripheral edge and top surface, the cables thereby holding the base to the ground by exerting a substantially direct downward leverage force on said base at said peripheral edge in response to tipping forces exerted on the base by the wind-driven housing, and thereby restraining the housing by its restraint of the clips held in place by reaction with the ground.

2. A combination according to claim 1 in which said clips are made of metal and in which said attachments means are screws.

3. A combination according to claim 1 in which said cables are either flexible organic plastic, braided flexible metal, or flexible metal covered by organic plastic.

4. A combination according to claim 1 in which said bottom surface is honeycombed with pockets formed between ribs to lighten the weight of the base.

5. Retention apparatus for a housing to be secured against strong winds, such a housing having a bottom end with a perimeter, said retention apparatus comprising:

a rigid base intended to rest atop the ground having a top surface with a peripheral edge and a bottom surface below said peripheral edge and top surface, the said peripheral edge of said base being larger that the perimeter of the intended housing so as to form a ledge on said top surface extending around said housing when said housing rests atop said top surface;

at least two unitary clips, each having a pair of flanges making a right angle with each other, and each flange having holes therethrough to pass a fastener, one flange of each clip being intended to bear against said top surface, and the other of said flanges intended to bear against said housing, said clips being placed at opposite sides of said housing when installed;

fasteners extending through at least some of said holes for respectively fastening said flanges to said top surface and to said housing;

at least two flexible cables, each said cable having a free end and an attachment end for attachment to the respective one of said flanges which is fastened to said top surface;

an anchor attached to the free end of each said cables, said anchor having a sharp end adapted to be driven into the ground alongside said sidewall, pulling with its cable, said anchor being inherently adapted to react with the ground to resist being pulled out of the ground by a pull on the cables said cable when installed laying atop said ledge and laying against said top surface and bent directly over and against said peripheral edge, said cable below said peripheral edge intended to be driven substantially directly vertically into the ground in close adjacency to said sidewall to minimize its spacing therefrom and to provide a predominantly downwardly direction restraint on said base at said peripheral edge, the clips holding the housing to the pad and to the attachment ends of the cables, the cables thereby holding the pad to the ground and exerting a substantially downward leverage force on said edge in response to tipping forces exerted on the base by the wind-driven housing.

6. Retention apparatus according to claim 5 in which said clips are made of metal and in which said attachments means are screws.

7. Retention apparatus according to claim 5 in which said cables are either flexible organic plastic, braided flexible metal, or flexible metal covered by organic plastic.

8. Retention apparatus according to claim 5 in which said bottom surface is honeycombed with pockets formed between ribs to lighten the weight of the base.

9. A combination according to claim 1 in which said attachment end of each cable comprises a closed loop, said cable passing through an opening in the flange adjacent to said top surface, the respective fastener trapping said loop as it fastens the flange to the top surface.

10. Retention apparatus according to claim 5 in which said attachment end of each cable comprises a closed loop, said cable passing through an opening in the flange adjacent to said top surface, the respective fastener trapping said loop as it fastens the flange to the top surface.

* * * * *